US006561213B2

(12) United States Patent
Wang et al.

(10) Patent No.: US 6,561,213 B2
(45) **Date of Patent: *May 13, 2003**

(54) FLUID DISTRIBUTION SYSTEM AND PROCESS, AND SEMICONDUCTOR FABRICATION FACILITY UTILIZING SAME

(75) Inventors: Luping Wang, Brookfield, CT (US); Terry A. Tabler, Sandy Hook, CT (US); James A. Dietz, Hoboken, NJ (US)

(73) Assignee: Advanced Technology Materials, Inc., Danbury, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/874,084

(22) Filed: Jun. 5, 2001

(65) Prior Publication Data

US 2002/0007849 A1 Jan. 24, 2002

Related U.S. Application Data

(63) Continuation-in-part of application No. 09/624,478, filed on Jul. 24, 2000, now Pat. No. 6,453,924.

(51) Int. Cl.[7] ..... F17C 11/00

(52) U.S. Cl. ..... 137/263; 137/571; 137/334; 95/95; 95/106; 96/113

(58) Field of Search ..... 137/571, 572, 137/576, 263, 334; 95/95, 106, 133; 96/108, 113

(56) References Cited

U.S. PATENT DOCUMENTS 5,916,245 A * 6/1999 Tom ..... 62/46.1
5,980,608 A * 11/1999 Dietz et al. ..... 95/12
6,089,027 A * 7/2000 Wang et al. ..... 62/46.1

* cited by examiner

*Primary Examiner*—Kevin Lee
(74) *Attorney, Agent, or Firm*—William F. Ryann

(57) ABSTRACT

A fluid distribution system for supplying a gas to a process facility such as a semiconductor manufacturing plant. The system includes a main fluid supply vessel coupled by flow circuitry to a local sorbent-containing supply vessel from which fluid, e.g., low pressure compressed gas, is dispensed to a fluid-consuming unit, e.g., a semiconductor manufacturing tool. A fluid pressure regulator is disposed in the flow circuitry or the main liquid supply vessel and ensures that the gas flowed to the fluid-consuming unit is at desired pressure. The system and associated method are particularly suited to the supply and utilization of liquefied compressed gases such as trimethylsilane, arsine, phosphine, and dichlorosilane.

20 Claims, 1 Drawing Sheet

FLUID DISTRIBUTION SYSTEM AND PROCESS, AND SEMICONDUCTOR FABRICATION FACILITY UTILIZING SAME

RELATED APPLICATIONS

This application claims the benefit of U.S. patent application Ser. No. 09/624,478 filed on Jul. 24, 2000, U.S. Pat. No. 6,453,924. Additionally this application claims priority to and repeats a substantial portion of prior application entitled "FLUID DISTRIBUTION SYSTEM AND PROCESS, AND SEMICONDUCTOR FABRICATION FACILITY UTILIZING SAME" filed on Jul. 24, 2000, which was accorded Ser. No. 09/624,478 since this application names the inventors named in the prior application, the application constitutes a continuation-in-part of the prior application. This application incorporates by reference the prior U.S. patent applictation Ser. No. 09/624,478, filed on Jul. 24, 2000, entitled "FLUID DISTRIBUTION SYSTEM AND PROCESS, AND SEMICONDUCTOR FABRICATION FACILITY UTILIZING SAME" to LUPING WANG, TERRY A. TABLER, and JAMES A. DIETZ.

FIELD OF THE INVENTION

This invention relates to a fluid distribution system and process, useful in applications such as manufacturing semiconductor materials and devices.

DESCRIPTION OF THE RELATED ART

In the semiconductor manufacturing field, trimethylsilane (3MS) and other liquefied compressed gases such as dichlorosilane, arsine and phosphine have been widely used or are currently emerging as important precursors for low dielectric constant (low k) materials in the fabrication of capacitors, memory cells and other microelectronic device structures.

As used herein, the term "low pressure" refers to pressure levels below about 1500 torr, the term "liquefied compressed gases" refers to fluids that are in liquid form at 25° C. and the term "low pressure compressed liquefied gas" refers to fluids that are in liquid form at 25° C. at pressure <100 psig.

The challenge attending the use of these liquefied compressed gas materials is to provide safe and efficient storage and delivery to the tools of such liquefied compressed gases. An additional challenge encountered is the need to provide high purity materials within the semiconductor industry. Contaminants within these liquefied compressed gas materials can lead to defects within the semiconductor device. Defects translate directly into reduced product yield and reduced profits. As an illustration, 3MS is a low pressure compressed liquefied gas with a vapor pressure of ~12 psig at room temperature.

Due to its flammability, toxicity and its potential fluid release or spill, 3MS cylinders or other supply vessels containing the liquefied compressed gas cannot be installed inside the semiconductor manufacturing facility (fab) in large quantity.

In consequence, the source vessel for the 3MS liquid is required to reside outside the fab. When it is in use, the 3MS is drawn from the outside vessel through associated flow lines into the fab, where it flows to the semiconductor manufacturing tool. Such 3MS can be vaporized after withdrawal in liquid form from the vessel, or the withdrawn fluid can be vapor, as drawn off from a vapor phase overlying the liquid in the supply vessel.

Since the vapor pressure of the liquefied compressed gas is quite low at room temperature, and can be affected by the environmental temperature at the (outside the building) storage site, it is difficult to achieve a reasonably high flow rate (e.g., 6 standard liters per minute, slpm) in conventional flow lines during cold weather conditions.

In addition, condensation in the vapor delivery lines adversely affects the flow stability, and causes undesirable fluctuations in the desired line pressure and volumetric flow rate of the vapor deriving from the liquefied compressed gas. Condensation in the tool can in some instances cause or require tool shutdown.

These are substantial problems that severely impact the use of liquefied compressed gases in the semiconductor manufacturing industry.

Corresponding problems attend the use of liquefied compressed gases in other industrial processes.

SUMMARY OF THE INVENTION

The present invention relates to a fluid distribution system and process, useful in applications such as manufacturing semiconductor materials and devices.

In one aspect, the invention relates to a fluid supply system for supplying fluid to a point-of-use fluid-consuming unit, such system comprising:

- a main fluid supply vessel;
- a local supply vessel, containing a physical sorbent having affinity for the fluid;
- first flow circuitry interconnecting the main fluid supply vessel and the local supply vessel, with a pressure regulator in at least one of the first flow circuitry and the main fluid supply vessel, so that fluid is flowed into the local supply vessel at pre-determined pressure; and
- second flow circuitry coupling the local supply vessel with said fluid-consuming unit, arranged so that fluid is dispensed from the local supply vessel through the second flow circuitry to the fluid-consuming unit.

Another aspect of the invention relates to a low pressure compressed liquefied gas supply system, for supply of corresponding gas to a point-of-use gas-consuming unit, such system comprising:

- a main liquid supply vessel;
- a local supply vessel, containing a physical sorbent having affinity for gas deriving from the liquefied compressed gas;
- first flow circuitry interconnecting the main liquid supply vessel and the local supply vessel, a sub-atmospheric pressure regulator in at least one of the first flow circuitry and the main liquid supply vessel, so that gas deriving from the liquefied compressed gas is flowed into the local supply vessel at sub-atmospheric pressure;
- second flow circuitry coupling the local supply vessel with the gas-consuming unit, arranged so that gas is dispensed from the local supply vessel through the second flow circuitry to the gas-consuming unit.

A still further aspect of the invention relates to a process for supplying a fluid to a fluid-consuming operation, comprising:

- providing a main fluid supply unit;
- providing a local supply unit coupled in fluid flow communication with the main fluid supply unit, such local supply unit comprising a physical sorbent having affinity for the fluid;
- flowing fluid from the main fluid supply unit on demand to the local supply unit, to maintain fluid in the local supply unit; and discharging fluid from the local supply unit to the fluid-consuming unit, wherein fluid flow from the main fluid supply unit to the local supply unit is selectively regulated in the fluid flow communication between the main fluid supply unit and local supply unit, or in the main supply unit.

Other aspects, features and embodiments in the invention will be more fully apparent from the ensuing disclosure and appended claims.

BRIEF DESCRIPTION OF THE DRAWINGS

For a more complete understanding of the present invention and advantages thereof, reference is now made to the following descriptions taken in conjunction with the accompanying drawings in which like reference numbers indicate like features and wherein.

DETAILED DESCRIPTION OF THE INVENTION

Figure 1:
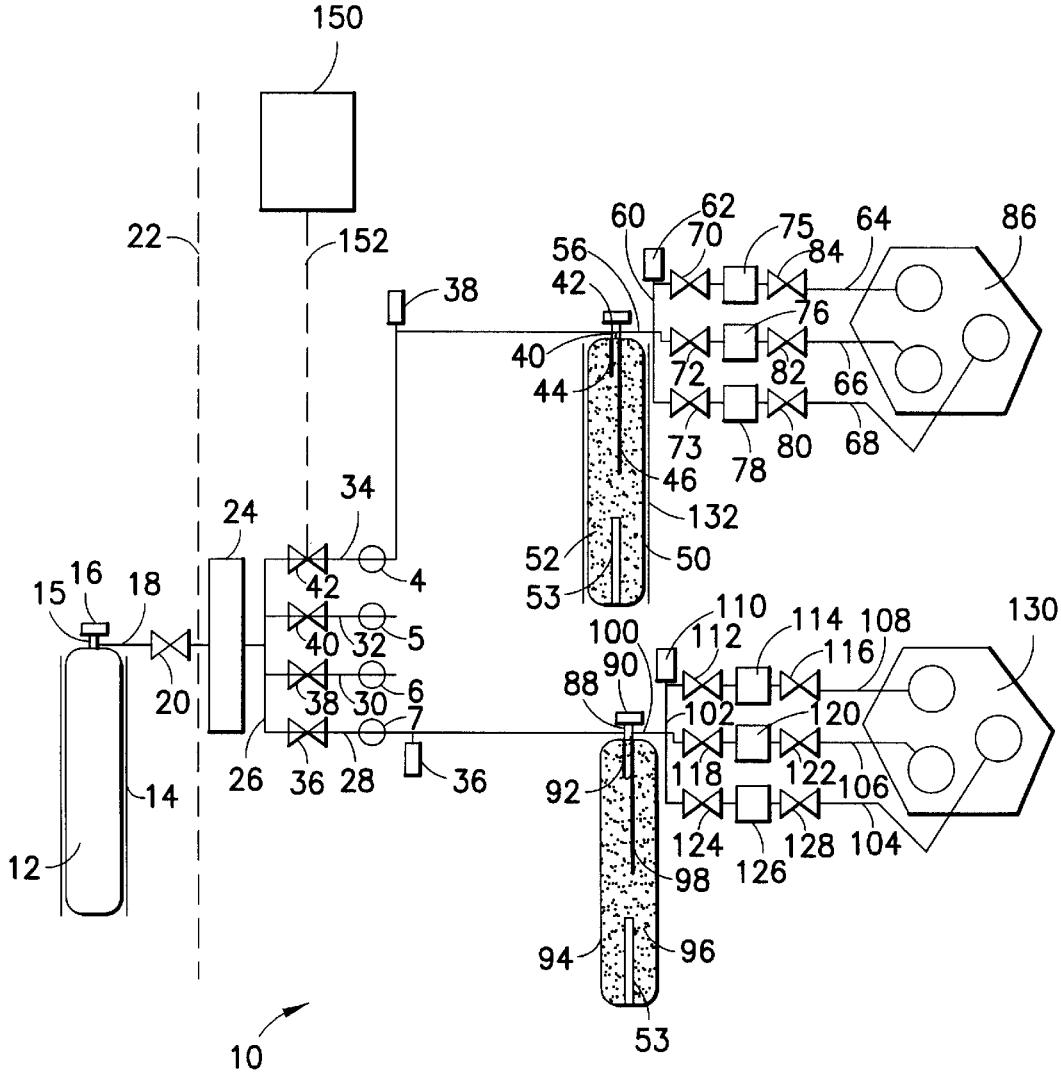
FIG. 1 is a schematic representation of a process system according to one embodiment of the present invention.

Preferred embodiments of the present invention and its advantages are understood by referring to FIG. 1 of the drawing, like numerals being used for like and corresponding parts of the various drawings.

The disclosures of the following U.S. patents and patent applications are hereby incorporated herein by reference in their respective entireties: U.S. Pat. Nos. 5,518,528 issued May 21, 1996; 5,704,965 issued Jan. 6, 1998; 5,704,967 issued Jan. 6, 1998; 5,707,424 issued Jan. 13, 1998; U.S. patent application Ser. No. 09/300,994 filed Apr. 28, 1999 in the names of Luping Wang and Glenn M. Tom for "FLUID STORAGE AND GAS DISPENSING SYSTEM;" U.S. patent application Ser. No. 09/067,393 filed Apr. 28, 1998 in the names of Luping Wang and Glenn M. Tom for "FLUID STORAGE AND GAS DISPENSING SYSTEM;" and U.S. patent application Ser. No. 09/532,268 filed Mar. 22, 2000 in the name of Luping Wang for "COMPRESSED FLUID DISTRIBUTION SYSTEM AND METHOD, AND SEMICONDUCTOR FABRICATION FACILITY UTILIZING SAME."

The fluid distribution system and process of the present invention provide a means and method for supplying a fluid from a source of same to a local supply vessel. The invention is advantageously employed for example where the fluid to be used is of a hazardous character.

The system and process of the invention are suitable for supplying fluids of varying types, including, without limitation, low pressure compressed liquefied gases, liquid compressed gases, high pressure gases, liquids and compressed gases.

The system and process of the invention are particularly well adapted for distribution of trimethylsilane and similar fluid reagents, in semiconductor manufacturing operations.

In such semiconductor manufacturing applications, the system and process of the present invention alleviate the difficulties associated with lag time between an external fluid supply vessel, e.g., a supply tank situated outside a semiconductor manufacturing fab, and a semiconductor manufacturing tool in the semiconductor manufacturing fab utilizing gas deriving from such fluid. By way of illustration, an exterior 3MS supply vessel in a conventional semiconductor manufacturing fab may be as much as several hundred meters away from the semiconductor manufacturing tool, or even farther, depending on plant layout. In such environment, the system and process of the invention function effectively to ensure that flow of gas feed to the tool is maintained at appropriate levels in even very low temperature environments, e.g., where the exterior 3MS supply vessel associated with the semiconductor manufacturing facility is exposed to below 0° C. conditions. The invention also permits 3MS to be used in the semiconductor manufacturing facility at low pressure levels consistent with enhanced safety of operation.

In an illustrative embodiment, the main fluid supply vessel and local supply vessel are arranged so that the local supply vessel is continuously refilled as needed from the main fluid supply vessel. The local supply vessel thereby provides immediately available gas to the semiconductor manufacturing tool (or other gas-consuming unit in the process system). Such arrangement is particularly advantageous for low pressure, high flow gas usage applications.

The system and process of the invention permit a local supply vessel to be placed in close proximity to the semiconductor tool or other gas-consuming unit, as a point-of-use gas source therefor.

The proximity of the local supply vessel to the point-of-use gas-consuming unit in the system and process of the invention is advantageous, since such configuration permits the damping of flow surges in flow circuitry that might otherwise occur in supplying gas from a remote fluid source. The proximity of the local supply vessel to the point-of-use gas-consuming unit further assists in reducing or even eliminating functional interference ("cross-talk") between flow control elements such as mass flow controllers in the flow circuitry of the process facility. This is especially advantageous where a substantial number of semiconductor tools or other gas-consuming units are employed, all receiving gas from the same external source or bulk supply.

The main fluid supply vessel in the practice of the present invention can be of any suitable type. Particularly preferred vessels include fluid vessels having a regulator associated with the outlet port of the vessel or otherwise interiorly disposed in the interior volume of the vessel, such as those commercially available from Advanced Technology Materials, Inc. (Danbury, Conn.) under the trademarks VAC and VAC-SORB. The main fluid supply vessel alternatively can comprise a vessel containing a physical adsorbent material with sorptive affinity for the fluid that is stored in and dispensed from the vessel. Sorbent-containing vessels of such type are commercially available from Advanced Technology Materials, Inc. (Danbury, Conn.) under the trademark SAGE.

As still further alternatives, the main fluid supply vessel may comprise a high pressure cylinder, an ISO module or a tube trailer.

The system and process of the present invention eliminate the need for toxic or flammable gases to be stored in the end-use facility at above-atmospheric pressure. The main fluid supply vessel can be remotely located, e.g., outside the semiconductor manufacturing fab building. Local supply vessels can be arranged to store and dispense gas deriving from fluid supplied to the local vessels from the main fluid supply vessel, with the local vessels holding and dispensing gas at low pressure, e.g., atmospheric or sub-atmospheric pressure, to provide enhanced safety in the operation of the overall process facility.

As a result of such enhanced safety character, the system and process of the invention permit usage of single-walled tubing in the process facility, rather than the double-walled (co-axial) tubing that is frequently used in industrial manufacturing operations to protect against leakage of hazardous pressurized gas into a work area.

In a preferred embodiment of the present invention, the main fluid supply vessel is an internal regulator-equipped VAC™ vessel (commercially available from Advanced Technology Materials, Inc., Danbury, Conn.). The regulator is set at an appropriate pressure level for flow of dispensed fluid to the local supply vessel, and the set point of the regulator for such purpose can be fixed, or the regulator may be of a variable set point character.

From the local supply vessel, gas (deriving from the fluid dispensed to the local supply vessel from the main fluid supply vessel), then is continuously or intermittently dispensed from the local supply vessel and flowed to the semiconductor tool or other locus of use.

The local supply vessel and the main fluid supply vessel in such system are preferably interconnected and arranged so that when the pressure in the local supply vessel falls below the set point pressure of the regulator of the VAC™ main fluid supply vessel, fluid will flow from the VAC™ vessel to the local supply vessel. By such arrangement, a satisfactory inventory of gas can be maintained in the local supply vessel, so that flow of gas from the local supply vessel to the gas-consuming unit is uninterrupted during active processing in the gas-consuming unit.

The fluid in the main fluid supply vessel can be of any suitable type, e.g., multi-component fluid mixtures, or a single-component fluid. Illustrative fluid species usefully employed in the practice of the present invention include, without limitation, $WF_6$, $AsH_3$, $PH_3$, $(CH_3)_3SiH$, $SiCl_4$, $NH_3$, $Cl_2$, $SiHCl_3$, $GeF_4$, HBr, HCl, HF, $SF_6$, $CH_3SiH_3$, $(CH_3)_2SiH_2$, $SiH_2Cl_2$, $GeH_4$, $H_2Se$ and $H_2S$, etc.

The fluid contained in the main fluid supply vessel may be in liquid and/or gaseous/vapor form therein. If the fluid is in liquid form in the main supply vessel, fluid in vapor form can be dispensed from the vapor phase overlying such liquid.

Various process arrangements can be employed, as will be appreciated by those skilled in the art, wherein fluid is contained in the main fluid supply vessel in a non-gaseous form, (e.g., low pressure compressed liquefied gases, liquid compressed gases, high pressure gases, liquids and compressed gases) and gas ultimately is furnished to the gas-consuming unit in the overall process system, by volatilization, vaporization, evaporation, etc..

Contaminants present in the gas to be delivered gas consuming unit can be removed within the local supply vessel. The removal of these contaminants can be effected by preferentially retaining these contaminants within the sorbent. For example, relatively heavy contaminants may remain bonded to the sorbent within the local supply vessel. Thus, gases exiting the local supply vessel exhibit an improved purity over those being supplied to the local supply vessel. In an alternative embodiment, a purification element can be located within the local supply vessel. This purification element binds with contaminants such as water, oxygen, carbon dioxide, oxidants or other process contaminates as known to those skilled in the art. In yet another embodiment of the present invention, purification materials can be incorporated into the sorbent to bind with contaminants in order to retain these contaminants within the local supply vessel.

Referring now to the drawing, which shows a schematic flow sheet of a process system according to one embodiment of the invention, the liquefied compressed gas supply system 10 is shown as comprising a main liquid supply vessel 12 exterior to the building (with the building represented by the dashed line 22).

The main liquid supply vessel 12 can comprise a conventional high pressure supply vessel defining an enclosed interior volume holding the liquefied compressed gas, in a liquid state.

In another, and preferred embodiment, the main liquid supply vessel 12 has an regulator associated with the outlet port of the vessel, arranged so that the fluid dispensed from the vessel passes through a fluid pressure regulator prior to passage through a flow control valve (opposite to the conventional arrangement wherein the fluid flows first through a flow control valve and then passes through a downstream regulator). Preferably, the regulator is interiorly disposed in the vessel, as more fully described in U.S. patent application Ser. No. 09/300,994 filed Apr. 28, 1999 in the names of Luping Wang and Glenn M. Tom for "FLUID STORAGE AND GAS DISPENSING SYSTEM;" U.S. patent application Ser. No. 09/067,393 filed Apr. 28, 1998 in the names of Luping Wang and Glenn M. Tom for "FLUID STORAGE AND GAS DISPENSING SYSTEM" and U.S. patent application Ser. No. 09/532,268 filed Mar. 22, 2000 in the name Luping Wang for "FLUID STORAGE AND DISPENSING SYSTEM FEATURING INTERIORLY DISPOSED AND EXTERIORLY ADJUSTABLE REGULATOR FOR HIGH FLOW DISPENSING OF GAS." As mentioned, vessels of such type are commercially available from Advanced Technology Materials, Inc. (Danbury, Conn.) under the trademark VAC.

In a preferred embodiment of the present invention, the main liquid supply vessel 12 is a vessel with an interiorly disposed regulator, which is arranged so that the set point of the regulator is variable and adjustable exteriorly of the vessel, as described in the aforementioned U.S. patent application Ser. No. 09/532,268 filed Mar. 22, 2000 in the name of Luping Wang for "FLUID STORAGE AND DISPENSING SYSTEM FEATURING INTERIORLY DISPOSED AND EXTERIORLY ADJUSTABLE REGULATOR FOR HIGH FLOW DISPENSING OF GAS."

Alternatively, the liquid supply vessel can be arranged with an external regulator downstream from the valve head of the vessel, in a conventional manner, and with the external regulator set to a predetermined, e.g., subatmospheric, pressure set point.

Alternatively, the main liquid supply vessel 12 is positioned in a heating blank 14 for heating the main liquid supply vessel 12 and its contents, to volatilize the fluid from the liquid phase.

The main supply vessel 12 is shown as being of cylindrical, elongate form, with a valve head 15 joined to the vessel at its upper neck region. The valve head in the embodiment shown is equipped with a hand wheel 16 or other valve actuator means (e.g., an automatic valve actuator) to open, close or modulate the valve in the valve head 15.

The valve head 15 is joined to a fluid discharge line 18 having flow control valve 20 therein. The flow control valve 20 may be under computer control, by actuator linkage to a central processor unit or other automatic control system, to vary the open/closed character of such valve in use.

The fluid discharge line 18 enters the building 22 of the semiconductor manufacturing facility, and connects to the manifold line 26, as shown. Alternatively the fluid discharge line 18 has disposed therein a condensation suppression unit 24, which serves to suppress condensate transport to the downstream equipment in the semiconductor manufacturing facility.

The condensation suppression unit 24 is especially useful in applications where the main liquid supply vessel 12 is of the super-atmospheric type and may be of any suitable type, and can for example comprise one or more of the following elements:

(i) a condensate collection vessel or condensate knock-out drum, for removing condensate from the vapor discharge line (such condensate removal components can for example be arranged such that the downstream piping is elevationally above the level of the condensate suppression unit, so that gravitational liquid drainage is utilized to achieve complete liquid removal);

(ii) a heater to heat the vapor discharge line and vapor therein, so that condensation is prevented (i.e., by heating the vapor so that it is above its dew point in the downstream portion of the process system);

(iii) a membrane or other vapor-permeable, liquid-impermeable barrier element, so that liquid present in the vapor is not transported downstream;

(iv) a filter, for filtering particles from the vapor, as well as for accelerating liquid evaporation (to minimize the potential for liquid formation downstream of the condensate suppression unit); and (v) a multi-stage (e.g., two-stage) regulator, so that even if liquid present in the vapor stream reaches a first regulator, a second or further regulator will still retain functionality.

In addition to the specific components and associated techniques discussed above, it will be appreciated that the condensation suppression unit 24 can be constructed and operated in a wide variety of ways, to extract liquid from the vapor stream or to suppress any tendency of liquid to form in the lines downstream of such unit 24.

The manifold line 26 has respective branch lines 28, 30, 32 and 34 joined to it. It will be appreciated that any number of branch lines can be employed, each coupled with an associated local supply vessel. Branch line 34 is illustrative and contains a flow control valve 42 therein, upstream of a sub-atmospheric pressure regulator 4. The flow control valve 42 may be operatively linked to actuator or automatic control means to modulate or otherwise open or close the valve. Such control means may be operatively linked or integrated to an automatic control system, e.g., a central processor unit that also controls downstream as well as upstream valves of the overall system. Such an automatic control system 150 is schematically shown in FIG. 1 as being linked by signal transmission line 152 to the valve 42, it being understood that such control unit also may be operatively linked to each of flow control valves in lines 28, 30 and 32, e.g., in digital communication with a central processor unit (CPU).

The optional sub-atmospheric pressure regulator 4 in branch line 34 is of any suitable type, and can be of a fixed set point character, or alternatively can be selectively adjustable within a set point range. In either case, the regulator is set so that gas flowing downstream of the regulator is at a desired sub-atmospheric pressure level.

A pressure transducer 38 is disposed in branch line 34, and is arranged to monitor the pressure in branch line 34 downstream from the optional sub-atmospheric pressure regulator 4. The pressure transducer may be operatively coupled with the automatic control unit 150, so that the automatic control unit is pressure-responsive in character, to maintain a predetermined pressure and flow rate of gas in branch line 34.

Branch line 34 is coupled with valve head 40 of local supply vessel 50. Vessel 50 contains a physical sorbent 52 therein. The physical sorbent has sorptive affinity for the gas. Preferably, the physical sorbent has a high sorptive capacity to maximize the loading of gas in the vessel. Contaminants present in the gas can be removed within the local supply vessel. The removal of these contaminants or impuities can be effected by preferentially retaining these contaminants within the sorbent. For example, relatively heavy contaminants may be retained within sorbent 52 within vessel 50. These impurities may comprise nitrogen, oxygen, carbon monoxide, carbon dioxide, hydrocarbons, water or other such impurities as known to those skilled in the art. Thus, gases exiting vessel 50 exhibit an improved purity over those being supplied to vessel 50. In an alternative embodiment, a purification element 53 can be located within vessel 50. Purification element 53 binds with contaminants such as nitrogen, oxygen, carbon monoxide, carbon dioxide, hydrocarbons, water, oxidants or other process contaminates as known to those skilled in the art. In yet another embodiment of the present invention, purification materials can be incorporated into sorbent 52 to bind with contaminants in order to retain these contaminants within vessel 50. The sorbent or purification material may comprise a molecular sieve, getter, zeolites, metal-organic compounds or other such material as is known to those skilled in the art.

Fluid from the branch line 34 enters the valve head 40, which is equipped with hand wheel 42, or other actuator or controller, for the valve (not shown) in valve head 40. In such manner, flow communication can be selectively established between the branch line 34 and the interior volume of vessel 50. For such purpose, the valve head is suitably of a two-port type.

Joined to valve head 40 is a gas fill conduit 44, which functions to introduce gas into the interior volume of the vessel, for sorptive take-up by the sorbent 52 therein.

In one embodiment of the present invention, local supply vessel 50 may be positioned in a heating blank 132 for heating the local supply vessel and its contents to increase gas flow rates at lower cylinder pressures.

In a further embodiment the local supply vessel 50 may have a regulator associated with the outlet port of the vessel, (not shown) arranged so that the fluid dispensed from the vessel passes through a fluid pressure regulator prior to passage through a flow control valve. Preferably, the regulator is interiorly disposed in the vessel, as more fully described in U.S. patent application Ser. No. 09/300,994 filed Apr. 28, 1999 in the names of Luping Wang and Glenn M. Tom for "FLUID STORAGE AND GAS DISPENSING SYSTEM;" U.S. patent application Ser. No. 09/067,393 filed Apr. 28, 1998 in the names of Luping Wang and Glenn M. Tom for "FLUID STORAGE AND GAS DISPENSING SYSTEM" and U.S. patent application Ser. No. 09/532,268 filed Mar. 22, 2000 in the name Luping Wang for "FLUID STORAGE AND DISPENSING SYSTEM FEATURING INTERIORLY DISPOSED AND EXTERIORLY ADJUSTABLE REGULATOR FOR HIGH FLOW DISPENSING OF GAS." As mentioned, vessels of such type are commercially available from Advanced Technology Materials, Inc. (Danbury, Conn.) under the trademark VAC.

In a preferred embodiment of the present invention, the local supply vessel 12 is a vessel with an interiorly disposed regulator, which is arranged so that the set point of the regulator is variable and adjustable exteriorly of the vessel, as described in the aforementioned U.S. patent application Ser. No. 09/532,268 filed Mar. 22, 2000 in the name of Luping Wang for "FLUID STORAGE AND DISPENSING SYSTEM FEATURING INTERIORLY DISPOSED AND EXTERIORLY ADJUSTABLE REGULATOR FOR HIGH FLOW DISPENSING OF GAS." Vessel 50 also is equipped with an interior discharge conduit 46 joined to the valve head. The valve head in turn is joined to exterior gas discharge line 56. By appropriate opening or closing of the valve in the valve head 40, gas flow communication can be established through the valve head between the interior volume of vessel 50 and the exterior fluid discharge line 56.

The exterior fluid discharge line 56 is joined to manifold 60 as shown. The manifold 60 contains a pressure transducer 62 therein. The transducer is operatively arranged to output a pressure signal, which in like manner to pressure transducer 38 can be coupled in signal transmission relationship to the automatic control unit 150.

The manifold 60 is joined to three branch lines 64, 66 and 68, each of which is joined to a chamber of a three-chamber tool 86.

Branch line 64, joined to a first chamber of the three-chamber tool, has an upstream flow control valve 70, a mass flow controller 75, and a downstream flow control valve 84 disposed therein, by means of which the flow of gas to the first chamber of the three-chamber tool is controllable with high precision.

In like manner, branch line 66 delivers gas to a second chamber of the three-chamber tool, and contains upstream flow control valve 72, mass flow controller 76 and downstream flow control valve 82 therein.

Branch line 68 is joined to a third chamber of the three-chamber tool, and contains an upstream flow control valve 73, mass flow controller 78 and downstream flow control valve 80 therein.

Referring again to the upstream portion of the system, in relation to the part just described, branch line 28 therein is correspondingly arranged in the manner described for branch line 34. The branch line 28 contains flow control valve 36 and sub-atmospheric pressure regulator 7 therein. Branch line 28 also has disposed therein a pressure transducer 36, arranged analogously to pressure transducer 38 in branch line 34. Such pressure transducer can be operatively linked in signal transmission relationship to the automatic control unit 150, with the automatic control unit in turn being operatively linked to an actuator for flow control valve 36 in such branch line 28.

Branch line 28 is joined to valve head 88 of local supply vessel 94 containing a bed of physical sorbent material 96 therein. Valve head 88 has gas fill conduit 92 joined thereto, for introducing gas from branch line 28 into the interior volume of vessel 94, for sorptive loading on the bed of physical sorbent material 96 therein.

An interior vapor discharge conduit 98 is joined to valve head 88. The valve head is equipped with a hand wheel or actuator 90, by which the valve in valve head 88 can be opened and fluid can be desorbed from the sorbent and dispensed into external discharge line 100.

External line discharge line 100 is joined to manifold 102 as shown. Manifold 102 in turn has three branch lines 104, 106 and 108 joined thereto and each is coupled to a respective one of three chambers in a three-chamber tool 130. The three-chamber tool 130 may be of similar or alternatively of different type, with respect to three-chamber tool 86 previously described.

Branch line 104, joined to a first chamber of the three-chamber tool 130, has upstream flow control valve 124, mass flow controller 126 and downstream flow control valve 128 therein, so that a highly controllable flow of gas to the tool 130 is achieved.

In like manner, branch line 106 contains upstream flow control valve 118, mass flow controller 120 and downstream flow control valve 122 therein.

Branch line 108 is correspondingly constructed and arranged, having upstream flow control valve 112, mass flow controller 114 and downstream flow control valve 116 therein.

Referring again to the upstream portion of the process system, the manifold line 26 has additional branch lines 30 and 32 joined thereto. These additional branch lines are shown as being similarly constructed to branch lines 28 and 34.

Branch line 30 has flow control valve 38 therein upstream of sub-atmospheric pressure regulator 6. Branch line 32 has flow control valve 40 therein, upstream of sub-atmospheric pressure regulator 5.

The branch lines 30 and 32 are shown as being unconnected to downstream flow circuitry for ease of illustration, but it is to be appreciated that each of such branch lines could be connected to separate local storage vessels, associated manifolds and semiconductor manufacturing tools, in the same manner as the other branch lines 28 and 34, or alternatively in a different manner.

It will be appreciated that the upstream manifolding and flow circuitry can be widely varied, to accommodate a greater or lesser number of semiconductor manufacturing tools, relative to the arrangement specifically shown.

Further, it will be appreciated that some or all of the respective system valves and pressure transducers, as well as other control elements, can be operatively interconnected with the automatic control unit 150, which can be programmatically arranged to vary the system operating conditions depending on sensed process characteristics of the gas streams in the system (e.g., with respect to temperature, pressure, flow rate and composition of the gas).

The semiconductor manufacturing tools 86 and 130 may be the same as, or different from, one another. Such tools may be arranged to conduct a variety of semiconductor manufacturing operations, depending on the specific gas that is dispensed into the system. Such semiconductor manufacturing operations may for example include deposition of epitaxial thin films, deposition of coatings, etching, cleaning, application of mask materials, introduction of dopant or impurity species, etc.

In operation, the main liquid supply vessel 12 holds liquefied compressed gas in a liquid state. The liquid is selectively heated in the vessel 12 to generate vapor. This vapor flows through valve head 15 to fluid discharge line 18 and through open flow control valve 20 to the condensation suppression unit 24.

In the condensation suppression unit, the liquid present in the stream is removed and the stream is processed so that condensate formation in the downstream flow lines and equipment is avoided.

Gas next flows from the condensation suppression unit 24 into the manifold line 26, and then through open valves 36 and 42 into the branch lines 28 and 34, respectively. The gas flows in the respective lines through sub-atmospheric pressure regulators 7 and 4. These sub-atmospheric pressure regulators are set to respective sub-atmospheric pressure set point values.

The gas flows in the respective lines 28 and 34 to the local supply vessels 94 and 50, with the valve in the valve head of each respective vessel being open to permit their filling with the gas.

In subsequent dispensing of gas from the local supply vessel 50, the valve in valve head 40 is opened to permit desorption of vapor from the sorbent 52 so that the gas flows through internal discharge line 46 to the external discharge line 56. From the external discharge line, the dispensed gas passes through the one(s) of the branch lines in which the corresponding valve(s) (70, 72, 73, 80, 82, 84) are open. The gas then flows to respective one(s) of the multi-chamber tool 86.

In like manner, gas is dispensed from the local supply vessel 94 by establishing communication between interior discharge line 98 and exterior discharge line 100. Gas thereby is desorbed from the sorbent 96 and flows to manifold 102. From the manifold, the gas flows through any of the branch lines 104, 106 and 108 in which the corresponding flow control valves are open, to permit flow of vapor to corresponding chamber(s) of the tool 130.

The valves in each of the branch lines of the respective manifolds downstream of the local supply vessels 50 and 94 are independently actuatable in relation to one another, so that for example while one chamber is actively receiving vapor, another is in stand-by or non-flow condition.

While not shown, the respective tools 86 and 130 are suitably constructed and operated to direct effluent, deriving from the gas, to an effluent treatment system. Such effluent treatment system can be arranged to capture or recycle the gaseous reagent within the effluent treatment system, or to otherwise effect disposition thereof.

The illustrative system arrangement just described thereby permits use of a conventional bulk liquid supply vessel for the reagent, outside of the fabrication facility, while within the facility, the corresponding gas is stored at low (e.g., sub-atmospheric) pressure in local supply vessels and dispensed at low pressure to the semiconductor manufacturing tool(s).

The local supply vessel thereby provides a point-of-use reservoir for reagent supply in the manufacturing facility, while the main liquid supply vessel serves as a continuous bulk supply source for the local supply vessels. Additionally, the local supply vessel serves to remove contaminants present in the gas to be delivered. The removal of these contaminants can be effected by preferentially retaining these contaminants within the sorbent. In an alternative embodiment, a purification element can be located within the local supply vessel. In yet another embodiment of the present invention, purification materials can be incorporated into the sorbent in order to bind with contaminants.

Since the line pressure after the sub-atmospheric pressure regulator (e.g., regulator 7 in line 28, and regulator 4 in line 34) is lower than the vapor pressure of the reagent, the potential for gas condensation is minimized. Between the main liquid supply vessel containing liquid reagent and the sub-atmospheric pressure regulators, condensation problems are prevented by the condensation suppression unit.

Since the local supply vessels can be continuously charged with reagent at sub-atmospheric pressure, flow stability of the overall system is not adversely affected by such fill operations. At the same time, safety is improved by eliminating potential liquid spill susceptibility and resulting vapor discharge to the working environment.

In addition, the system of the invention eliminates condensation problems of the liquid downstream of the sub-atmospheric pressure regulator as a result of the low pressure operation.

It will be recognized that the main liquid supply vessel 12, while shown as a single vessel, can alternatively be provided in multiplicated form, as separate main liquid supply vessels that are manifolded or otherwise arranged so that the bulk supply and change-out issues are resolved by the continuous ability to flow reagent gas to the semiconductor manufacturing facility.

The sorbent utilized in the local supply vessels is of any suitable type having acceptable sorptive affinity for the specific gaseous reagent to be dispensed to the tool in the manufacturing facility. Examples of suitable sorbent materials include activated carbon, silica, alumina, molecular sieves, clays and macroreticulate resins, on which the gaseous reagent is physically adsorbable.

In one preferred embodiment, the main liquid supply vessel 12 is equipped with a sub-atmospheric pressure regulator in the interior volume of the vessel, and contains the low pressure compressed liquefied gas, e.g., trimethylsilane, with a discharge pressure (established by the set point of the internal regulator) in the range of 12 psig to 100 torr.

The local supply vessels 50 and 94 are in one embodiment equipped with a dual port valve head, having one port for discharge of the gas, and the other port for reloading the vessel with gas.

In such embodiment, the local supply vessels 50 and 94 each comprise a 49 liter cylinder containing activated carbon absorbent, having trimethylsilane gas adsorbed thereon, and arranged for delivery of approximately four kilograms (1,212 liters) of trimethylsilane gas from each vessel at a pressure in the range of from about 700 torr to about 100 torr at room temperature. Such system provides a continuous flow of gas at a flow rate of 6 standard liters per minute, for approximately 200 minutes. (Note: a moderate heating of the cylinder may be required for the flow rate at the lower cylinder pressure.)

As an example, if each semiconductor manufacturing tool uses trimethylsilane gas at such flow rate intermittently, for half of the process time, the total volume of required gas per day is about 4,320 liters. This volumetric dispensing service requires the 49 liter cylinder to be recharged with approximately 2,805 liters of gas a day.

If four tools are running in this example, 11,220 liters of gas are required from the main liquid supply vessel. This service requires an average flow rate of trimethylsilane from the main liquid supply vessel at a flow rate of 7.8 standard liters per minute. Such flow rate compares favorably to a 24 standard liters per minute requirement if only the main liquid supply vessel were to be used in a conventional system.

The FIG. 1 system therefore provides a highly efficient and safe configuration for supply of liquefied compressed gas reagents such as trimethylsilane. If such general type of gas storage and dispensing arrangement is used for other gases, such as arsine or phosphine, having relatively higher vapor pressure than trimethylsilane, flow rate constraints become less important. For example, if phosphine is supplied from the main liquid supply vessel, a flow rate of 10 standard liters per minute is readily achieved.

Since the main liquid supply vessel is located outside the semiconductor manufacturing facility, dangers associated with liquid spills are eliminated. Further, it is possible to site the main liquid supply vessel in an area remote from the semiconductor manufacturing facility, thereby enabling ready compliance with fire codes, environmental codes and safety regulations.

Further, since the gas line pressure in the semiconductor manufacturing plant is sub-atmospheric, in the practice of the invention, the potential for significant gas release in the case of a leak is substantially reduced.

While the invention has been illustratively described herein with reference to specific elements, features and embodiments, it will be recognized that the invention is not thus limited in structure or operation, but that the invention is to be broadly construed consistent with the disclosure herein, as comprehending variations, modifications and embodiments as will readily suggest themselves to those of ordinary skill in the art.

What is claimed is:

1. A low pressure compressed liquefied gas supply system, for supply of corresponding gas to a point-of-use gas-consuming unit, said system comprising:

a main liquid supply vessel;

a local supply vessel, containing a physical sorbent having affinity for gas deriving from said liquefied gas, and wherein said sorbent retains impurities from said fluid;

first flow circuitry interconnecting the main liquid supply vessel and the local supply vessel, a sub-atmospheric pressure regulator in at least one of said first flow circuitry and said main liquid supply vessel, so that gas deriving from said liquefied gas is flowed into the local supply vessel at sub-atmospheric pressure, and wherein the first flow circuitry is coupled with a condensation suppression unit, arranged and operated to prevent condensation in gas flowed into the local supply vessel.; and second flow circuitry coupling the local supply vessel with said point-of-use gas-consuming unit, arranged so that gas is dispensed from the local supply vessel through the second flow circuitry to the point-of-use gas-consuming unit.

2. The system of claim 1, further comprising a purification element within said local supply vessel.

3. The system of claim 1, wherein said suppression condensation unit comprises one or more of:

(a) a condensate collection vessel arranged to collect liquid from gas flowed from the main liquid supply vessel to the local supply vessel;

(b) a heater to heat the gas flowed from the main liquid supply vessel to the local supply vessel;

(c) a barrier element permeable to gas but impermeable to liquid, arranged for passage therethrough of gas flowed from the main liquid supply vessel to the local supply vessel;

(d) a filter arranged to accelerate liquid evaporation of liquid, in the gas flowed from the liquid supply vessel to the local supply vessel; and (e) a multiple stage regulator, wherein liquid penetration to a second or downstream stage of said multistage regulator is prevented when gas is flowed from the main liquid supply vessel to the local supply vessel.

4. The system of claim 1, wherein the first flow circuitry contains a sub-atmospheric pressure regulator.

5. The system of claim 1, wherein the main liquid supply vessel contains an interiorly disposed sub-atmospheric pressure regulator.

6. The system of claim 1, wherein said first flow circuitry includes flow control valves.

7. The system of claim 6, wherein the flow control valves are controlled by a process control unit.

8. The system of claim 1, further comprising a heater for heating the main liquid supply vessel to vaporize gas from the liquefied gas therein.

9. The system of claim 1, wherein the physical sorbent contained in the local supply vessel comprises a particulate sorbent formed of a material selected from the group consisting of carbon, activated carbon, silica, clays, alumina, molecular sieves, macroreticulate resins, and mixtures of two or more of the foregoing.

10. The system of claim 1, wherein the local supply vessel contains an activated carbon sorbent.

11. The system of claim 1, wherein said second flow circuitry contains at least one mass flow controller.

12. The system of claim 1, wherein the point-of-use gas-consuming unit comprises a multi-chamber semiconductor manufacturing tool.

13. The system of claim 12, wherein the flow circuitry comprises manifolded branch lines to each of separate chambers of the multi-chamber semiconductor manufacturing tool.

14. The system of claim 1, wherein at least one of the first flow circuitry and the second flow circuitry contains a pressure transducer for monitoring pressure of gas therein.

15. The system of claim 1, further comprising in said main liquid supply vessel a liquefied gas, and in said local supply vessel a corresponding gas.

16. The system of claim 15, wherein the liquefied gas in the main liquid supply vessel comprises at least one gas species selected from the group consisting of dichlorosilane, trimethylsilane, arsine and phosphine.

17. The system of claim 15, wherein the liquefied gas comprises a liquid whose gas phase is utilized in a semiconductor manufacturing operation.

18. The system of claim 1, wherein the main liquid supply vessel contains trimethysilane.

19. The system of claim 1, wherein said main liquid supply vessel is located exteriorly of a building that in its interior space contains the local supply vessel, point-of-use gas-consuming unit and second flow circuitry.

20. A semiconductor manufacturing facility comprising a low pressure compressed liquefied gas supply system as in claim 1.

* * * * *